US008931447B2

(12) United States Patent
Schulte et al.

(10) Patent No.: US 8,931,447 B2
(45) Date of Patent: Jan. 13, 2015

(54) DEVICE FOR CONTROLLING THE VALVE CONTROL TIMES OF AN INTERNAL COMBUSTION ENGINE

(75) Inventors: Andreas Schulte, Erlangen (DE); Rene Gunther, Hausen (DE); Andreas Strauss, Forchheim (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 96 days.

(21) Appl. No.: 13/703,995

(22) PCT Filed: Jun. 16, 2011

(86) PCT No.: PCT/EP2011/059985

§ 371 (c)(1),
(2), (4) Date: Dec. 13, 2012

(87) PCT Pub. No.: WO2011/160994

PCT Pub. Date: Dec. 29, 2011

(65) Prior Publication Data

US 2013/0087112 A1 Apr. 11, 2013

(30) Foreign Application Priority Data

Jun. 22, 2010 (DE) ..... 10 2010 024 596

(51) Int. Cl.
*F01L 1/34* (2006.01)
*F01L 1/344* (2006.01)

(52) U.S. Cl.
CPC . *F01L 1/34* (2013.01); *F01L 1/344* (2013.01); *F01L 1/3442* (2013.01); *F01L 2101/00* (2013.01); *F01L 2103/00* (2013.01)
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS

| | | | | |
|---|---|---|---|---|
| 6,964,250 | B2 * | 11/2005 | Wierl et al. | 123/90.17 |
| 7,484,486 | B2 * | 2/2009 | Knecht et al. | 123/90.31 |
| 7,798,111 | B2 * | 9/2010 | Kleiber et al. | 123/90.15 |
| 2005/0066922 | A1 | 3/2005 | Knecht et al. | |

FOREIGN PATENT DOCUMENTS

| | | |
|---|---|---|
| CN | 1533467 | 9/2004 |
| CN | 1769723 | 5/2006 |
| DE | 10335051 | 7/2004 |
| DE | 10334690 | 3/2005 |
| DE | 102004062071 | 7/2006 |
| DE | 102006019607 | 10/2007 |
| DE | 102006052998 | 7/2008 |
| DE | 102007039282 | 2/2009 |
| EP | 1865158 | 12/2007 |

(Continued)

*Primary Examiner* — Ching Chang
(74) *Attorney, Agent, or Firm* — Volep and Koenig, P.C.

(57) ABSTRACT

A device (1) for controlling and/or influencing the valve control times of an internal combustion engine, in particular to a camshaft adjustment device, which includes a drive element (2) which is fastened to an attachment part (3) with a screw connection (4), wherein the drive element (2) and/or the attachment part (3) are/is composed of a fiber-reinforced material. In order to obtain a more lightweight design and to be able to reduce screwing forces, the invention provides that at least one of the contact faces (5, 6) between the drive element (2) and the attachment part (3) is at least partially subjected to material-removing processing.

10 Claims, 2 Drawing Sheets

(56) References Cited

FOREIGN PATENT DOCUMENTS

| | | |
|---|---|---|
| EP | 2058478 | 5/2009 |
| WO | 0144627 | 6/2001 |
| WO | 2006074744 | 7/2006 |

* cited by examiner

DEVICE FOR CONTROLLING THE VALVE CONTROL TIMES OF AN INTERNAL COMBUSTION ENGINE

FIELD OF THE INVENTION

The invention relates to a device for controlling and/or for influencing the valve control times of an internal combustion engine, in particular, a camshaft adjustment device that comprises a drive element that is attached to an attachment part with a screw connection, wherein the drive element and/or the attachment part are made from a fiber-reinforced material.

BACKGROUND

A device of this type is known, for example, from EP 1 485 580 B1. Here, a drive for a valve drive control of a vehicle is described, wherein, in particular, a camshaft adjustment device is imagined. The device has at least one drive wheel and functional parts, in particular, the stator of the camshaft adjuster.

It is known to use steel or a sintered material on an iron basis for the required elements, in particular, for chain wheels or toothed belt wheels. In this way, a high strength of the components can be achieved. This is required, in particular, at the positions that must be fixed by means of a screw connection to another component. A disadvantage here is the not insignificant weight of the steel or sintered metal components. It is also known to use aluminum or another lightweight metal as a material for the components.

To be able to keep the weight of the components low, plastic is used, in particular, duroplastics, as described in the mentioned EP 1 485 580 B1. For example, toothed belt wheels can also be produced from duroplastic material. The components produced in this way are lighter than steel or sintered metal component, accordingly, however the material strength is also lower accordingly. The component strength is therefore increased in that reinforcement fibers, for example, glass fibers, are embedded in the base material. Connections between two components are produced, in turn, by means of screw connections.

If a metallic substance is used as the material for a component, a high strength is given for a high weight. The mass inertial forces or (in the case of rotation) the mass inertial moments are also high, accordingly, which is disadvantageous for a high dynamic response of the system. It is also usually necessary to perform additional surface or heat treatment processes, in order to be able to make the component optimally functional (leak tightness). Accordingly, high costs are usually given when such a solution is used due to a relatively complicated production.

If a solution is selected that uses plastics, the component strength is lower accordingly, even if reinforcement fibers are used. One particular weak spot is the group of locations that must be fixed on an attachment part by means of a screw connection.

SUMMARY

The present invention is based on the objective of constructing a device of the type noted above such that the use of a material of less density (plastic) is possible, so that a low component weight is given. Here, however, measures must be used selectively at the positions that must be fixed to another part by means of a screw connection, in order to produce a sufficient strength of the screw connection for a simple and lightweight construction. Accordingly, a lightweight construction should be achieved, wherein a high strength of the screw connection is to be guaranteed, despite the reduction of the screw-on forces.

The solution to meeting this objective by the invention is characterized in that at least one of the contact surfaces between the drive element and the attachment part is subjected at least partially to a material-removal process.

The at least one contact surface is here preferably ground. However, it could also be milled, for example.

The drive element is preferably a belt wheel or a chain wheel. The attachment part is preferably the stator of a camshaft adjustment device.

The fiber-reinforced material of the drive element and/or of the attachment part is advantageously a polymer material. This can be comprised of a phenolic resin or have phenolic resin. According to one preferred construction of the invention, the polymer material could also be a duroplastic.

The material could have a fiber reinforcement by means of glass, mineral, or carbon fibers.

One especially preferred embodiment of the invention provides that only the attachment part is made from fiber-reinforced material and only the contact surface of the attachment part is subjected to the material-removal process.

For the component that is affected, preferably a fiber-reinforced polymer material is provided. The reinforcement fibers (e.g., glass or mineral fibers) are embedded in a matrix of the base material.

The screw connections are more stable and stronger due to the proposed construction. This is possible because the material-removal process on the contact surfaces exposes fiber material of the component material, leading to a significant increase in the coefficient of friction on the contact surface.

After the production of the component made from fiber-reinforced material from plastic, the surface of the component is initially relatively smooth. The reinforcement fibers do not appear on the outside through the matrix of the base material. However, if the material-removal work of the contact surface is performed for a screw connection, fiber material is exposed with the mentioned effect. The contact of the exposed fibers on the component to be attached contributes significantly to the increase in the coefficient of friction.

Accordingly, a specified or required strength of the screw connection is achieved when lower contact forces are generated by the screw connection. Thus, a reduction of the screw forces can be accepted by the increase of the coefficient of friction of the components that are screwed together, without reducing the strength of the screw connection.

Thus, advantageously screws that are smaller or with lower strength properties can be used, which leads to lower weights and/or costs. This also leads to less component deformation due to the screw forces, so that, in general, smaller leakage losses are to be expected. The pressure stresses in the screw joint are also lower, so that it is possible to use a lighter weight, but also less strong material (e.g., other polymer materials or lightweight metal).

The use of the proposed design is for components or parts that are required in the control drive of an internal combustion engine (both Otto (gasoline) and also diesel engines). The application is imagined, as an example and in particular, for drive wheels for toothed belts, wherein these can be provided both on the side of the crankshaft and also on the side of the camshaft. The application is further imagined, above all, for camshaft adjusters and their components, especially for their belt wheels, stators, and housing covers.

Through the use of a fiber-reinforced material, in particular, a polymer material, a low component weight is advantageously achieved. Accordingly, the overall weight of the vehicle is also lower. Through the lower mass, the mass inertial moments are also lower accordingly, so that the control systems can operate with a more dynamic response for the valves of the internal combustion engine. This configuration can basically realize an increase in the dynamic response of the systems and thus lower fuel consumption. This configuration also further improves the oscillation behavior of the system.

BRIEF DESCRIPTION OF THE DRAWINGS

One embodiment of the invention is shown in the drawings. Shown are.

DETAILED DESCRIPTION OF THE PREFERRED EMBODIMENTS

Figure 1:
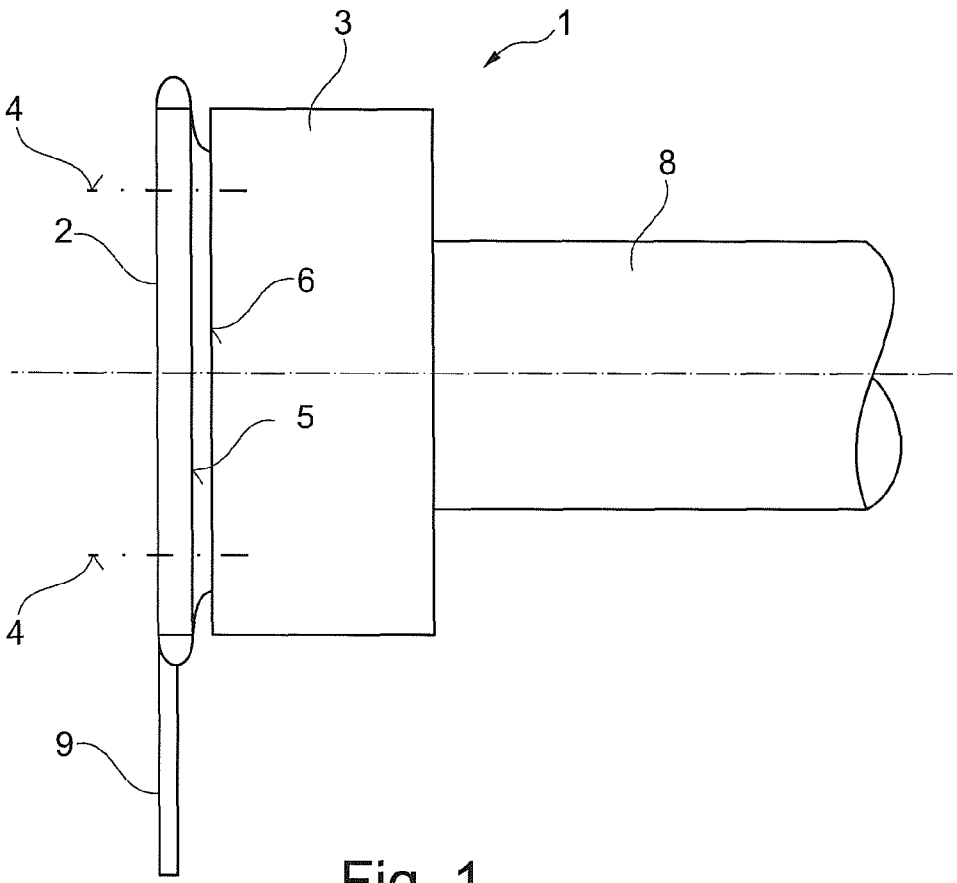
FIG. 1 schematically in a side view, a camshaft adjuster that has a belt wheel that is screwed on, FIG. 2 schematically, the surface of the camshaft adjuster at a position at which the belt wheel is to be screwed on, and after the injection molding process of the component.

In FIG. 1, a camshaft adjuster 1 of an internal combustion engine is shown schematically. The camshaft adjuster 1 is used in a known manner to perform an adjustment of an inner rotor that is connected to the camshaft 8 of the internal combustion engine relative to a stator 3 by means of a vane wheel (not shown) that is usually actuated hydraulically, so that an adjustment between an "advanced stop" and a "retarded stop" can be performed. The stator 3 is designated here as an attachment part.

The camshaft adjuster 1 has a drive element 2 that is in the form of a toothed belt wheel and is driven by the crankshaft of the internal combustion engine by means of a belt 9. The drive element 2 is screwed with the attachment part 3. A screw connection 4 is used for this purpose. The stator 3 rotates—driven by the drive element 2—at the rotational speed of the camshaft about an axis of rotation when the internal combustion engine is in operation.

The attachment part 3 has a contact surface 5 that is formed for the contact of a corresponding contact surface 6 of the drive element 2. During the installation of the drive element 2 on the attachment part 3, the contact surfaces 5 and 6 are brought into mutual contact accordingly and the fixing is produced with the screw connection 4.

Figure 2:
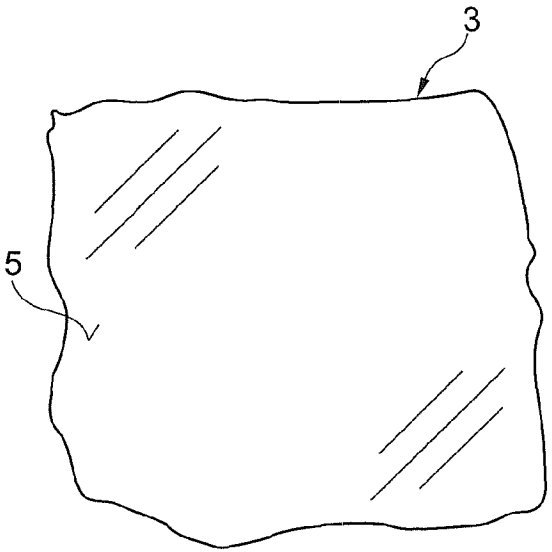

The attachment part 3 is formed of a polymer material in which reinforcement fibers are embedded. The attachment part 3 or its housing part is produced by an injection molding process. The fiber material is mixed in during the preparation of the melt for the injection molding process. When the injection molding process is completed, the fibers are located in the interior of the matrix of the base material. The surface of the attachment part 3 is smooth accordingly, which is indicated in FIG. 2, which shows the top view of a part of the surface of the molded and not yet further processed attachment part 3.

Figure 3:
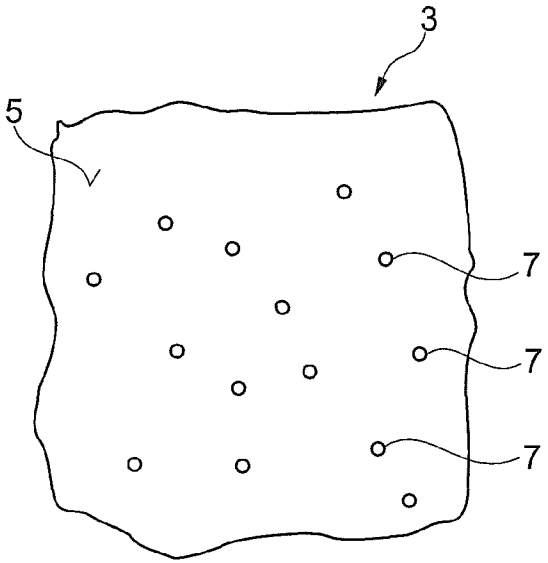
FIG. 3 shows, in the representation according to FIG. 2, the surface after a grinding process has been performed.

Before the drive element 2 is installed, the surface of the attachment part 3 in the area of the contact surface 5 is prepared as follows: the surface is subjected to a grinding process. This removes the surface material of the attachment part 3. This process exposes the fibers that are located in the material of the attachment part (i.e., of the housing) 3. In FIG. 3, this is shown schematically, where it is to be seen that the fibers 7 are visible and appear on the surface.

This process has the result that the coefficient of friction of the surface of the attachment part 3 is significantly increased in the ground area.

For increasing the coefficient of friction of the contact surface 5 that is clamped by means of the screw connection 4, a material-removal process is used, preferably a grinding process, wherein surface material is removed, so that the fibers 7 are exposed. The contact of the exposed fibers 7 to the friction partner contributes significantly to the increase in the coefficient of friction.

The material-removal work thus results in a removal of the matrix of the base material and the exposure of the fibers on at least one clamping surface of the screw joint.

If the drive element 2 is now screwed on the attachment part 3, much smaller pressing forces are needed between the parts 2 and 3, in order to create a defined hold. Accordingly, it is possible to work with screws of smaller dimensions or screws with lower strength properties.

LIST OF REFERENCE NUMBERS

1 Device for controlling and/or influencing the valve control times of an internal combustion engine (camshaft adjustment device)
2 Drive element (toothed belt wheel)
3 Attachment part (stator)
4 Screw connection
5 Contact surface
6 Contact surface
7 Reinforcement fiber
8 Camshaft
9 Belt

The invention claimed is:

1. A device for controlling or for influencing valve control times of an internal combustion engine, comprising a drive element that is attached to an attachment part with a screw connection, at least one of the drive element or the attachment part is made from a fiber-reinforced material, and at least one contact surface between the drive element and the attachment part is subjected at least partially to a material-removal process to partially expose fibers on the at least one contact surface.

2. The device according to claim 1, wherein the at least one contact surface is ground.

3. The device according to claim 1, wherein the at least one contact surface is milled.

4. The device according to claim 1, wherein the drive element is a belt wheel or a chain wheel.

5. The device according to claim 1, wherein the attachment part is a stator of a camshaft adjustment device.

6. The device according to claim 1, wherein the fiber-reinforced material of at least one of the drive element or the attachment part is a polymer material.

7. The device according to claim 6, wherein the polymer material is phenolic resin or includes phenolic resin.

8. The device according to claim 6, wherein the polymer material is a duroplastic.

9. The device according to claim 1, wherein the material includes a fiber reinforcement of at least one of glass, mineral, or carbon fibers.

10. The device according to claim 1, wherein only the attachment part is comprised of fiber-reinforced material and only the contact surface of the attachment part is subjected to the material-removal process.

* * * * *